US008718529B2

(12) United States Patent
Fukatsu et al.

(10) Patent No.: US 8,718,529 B2
(45) Date of Patent: May 6, 2014

(54) IMAGE FORMING APPARATUS PROVIDING GLOSSINESS TREATMENT

(75) Inventors: Makoto Fukatsu, Suntou-gun (JP); Yasunori Chigono, Atsugi (JP); Emi Hagiwara, Yokohama (JP); Shintaro Ishida, Toda (JP); Shunichi Takada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 13/316,828

(22) Filed: Dec. 12, 2011

(65) Prior Publication Data

US 2012/0155939 A1 Jun. 21, 2012

(30) Foreign Application Priority Data

Dec. 16, 2010 (JP) ..... 2010-280768

(51) Int. Cl.
*G03G 15/20* (2006.01)

(52) U.S. Cl.
USPC ..... 399/341

(58) Field of Classification Search
USPC ..... 399/341, 335, 53
See application file for complete search history.

(56) References Cited

U.S. PATENT DOCUMENTS

| | | | | |
|---|---|---|---|---|
| 7,024,149 | B2 | 4/2006 | Kito et al. | |
| 2004/0096250 | A1 | 5/2004 | Kito et al. | |
| 2010/0142986 | A1 * | 6/2010 | Davidson et al. | 399/69 |
| 2011/0206429 | A1 * | 8/2011 | Terao et al. | 399/341 |

FOREIGN PATENT DOCUMENTS

JP 2004-170548 A 6/2004

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes a plurality of image forming stations for forming a toner image having superposed toner image components on a recording material, a fixing portion for fixing the toner image on the recording material, and a glossiness treatment unit, operable when a glossiness treatment mode is selected, for glossiness treatment of the toner image fixed on the recording material by heating the toner image. The glossiness treatment unit includes a film movable in a feeding direction of the recording material, a heating member contacting the film, and a pressing member cooperating with the heating member to form a nip, with the film therebetween, for nipping and feeding the recording material. In the glossiness treatment mode, one of the image forming stations forms, as a topmost layer, a toner image having a tone gradation provided by a dot growth type screening, and an image forming station, other than the one for forming the topmost toner image, forms the toner image having the tone gradation provided by a line growth type screening.

16 Claims, 13 Drawing Sheets

IMAGE FORMING APPARATUS PROVIDING GLOSSINESS TREATMENT

FIELD OF THE INVENTION AND RELATED ART

The present invention relates to an image forming apparatus capable of changing in glossiness an image on a recording medium after the formation of the image on the recording medium.

Generally, the recording medium of a print, and the substance of which an image was formed on the recording medium of the print, are different in gloss. Thus, the gloss of a print is affected by the print ratio of the print. Thus, it has been proposed to process a print after the completion of the print, in order to make the print uniform in gloss. For example, Japanese Laid-open Patent Application 2004-170548 discloses a technology for making an image on a sheet of recording medium appear glossy or matte. According to this patent application, after an image is formed of thermoplastic resin (toner) on a sheet of recording medium, the surface of the thermoplastic image is reheated through a sheet of film, and then, is cooled, in order to make the surface glossy or matte.

The applicants of the present invention propose a technology which can change in gloss any part, parts, or entirety of the image formation area of a sheet of recording medium in order to provide an image on a sheet of recording medium with a greater variety of surface appearance (various levels of gloss, and/or matte). More concretely, it is a technology that uses a gloss changing apparatus (device) which employs a thermal head having a group of minute heat generating elements and uses a roll of extremely thin and heat resistant film, in which the thermal head is placed in contact. The group of heat generating elements is roughly 300 dpi (or higher).

The gloss changing process carried out by this gloss changing apparatus is as follows: a print is positioned so that the surface of a sheet of recording medium, on which an image formed of thermoplastic resin (black toner or color toners), or an image covered with a layer of thermoplastic resin, is present, comes into contact with the opposite surface of the film from the thermal head. Then, the print is partially or entirely heated by the thermal head, through the film, while being conveyed in contact with the film. Then, the print is cooled while being kept in contact with the film. Then, the film is separated from the print after the cooling of the print. As the print is subjected to the above-described process, the surface texture of the film is transferred onto the image areas of the print. Consequently, the image portions of the print are changed in gloss. If a roll of film with matted surfaces is used, the image on the print reduces in gloss. Further, various areas of the image of a print can be variously changed in gloss by selectively making the group of heat generating elements generate heat.

If it is wanted to enable a gloss changing apparatus (device) to partially changing an image in gloss, it is necessary to structure the gloss changing apparatus so that the effects of the activated heating elements (heating elements which are generating heat) of its thermal head, and the effects of the inactivated heating elements (heating elements which are not generating head) of the thermal head, are accurately reflected upon an image to be changed in gloss. For this purpose, it is desired that extremely thin film is used as the transfer film for a gloss changing apparatus. However, in a case where extremely thin film is used as the transfer film for a gloss changing apparatus, the transfer film is extremely small in thermal capacity compared to the image on a sheet of recording medium. Thus, as the transfer film is partially heated by the thermal head, the film instantly and partially becomes very high in temperature. Thus, only the topmost portion (topmost toner layer or thermoplastic layer) of the image, that is, the closest portion of the image to the film, is melted and deformed. Consequently, the image changes in gloss.

This method of using thin film as the transfer film for a gloss changing apparatus suffers from the problem that if the pixels of the topmost layer of the image of a print to be changed in gloss are structured in a certain way, the apparatus fails to transfer the texture of its transfer film onto the entirety of the areas of the image to be changed in gloss. For example, in a case where high gloss film is used as the transfer film, some areas of a print to be changed in gloss are not made as high in gloss as the transfer film. It is thought that the occurrence of this type of gloss imperfection is closely related to the pixel structure of the image layers of an image, which are under the topmost layer of the image, and that it is a phenomenon attributable to the above described instantaneous heating of the image on a sheet of recording medium by the transfer film.

SUMMARY OF THE INVENTION

Thus, the primary object of the present invention is to provide an image forming apparatus which does not output a print which suffers from gloss imperfection.

According to an aspect of the present invention, there is provided an image forming apparatus comprising an image forming unit for forming a toner image on a recording material; a fixing portion for fixing the toner image on the recording material; a glossiness treatment unit, operable when a glossiness treatment mode is selected, for glossiness treatment of the toner image fixed on the recording material by heating the toner image, said glossiness treatment unit including a film movable in a feeding direction of the recording material, a heating member contacted to said film, a pressing member cooperating with said heating member to form a nip, with said film therebetween, for nipping and feeding the recording material; wherein in the glossiness treatment mode, said image forming unit forms, as a topmost layer, a toner image having a tone gradation provided by a dot growth type screening.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

<1-1: General Structure of Image Formation Unit>

Figure 1:
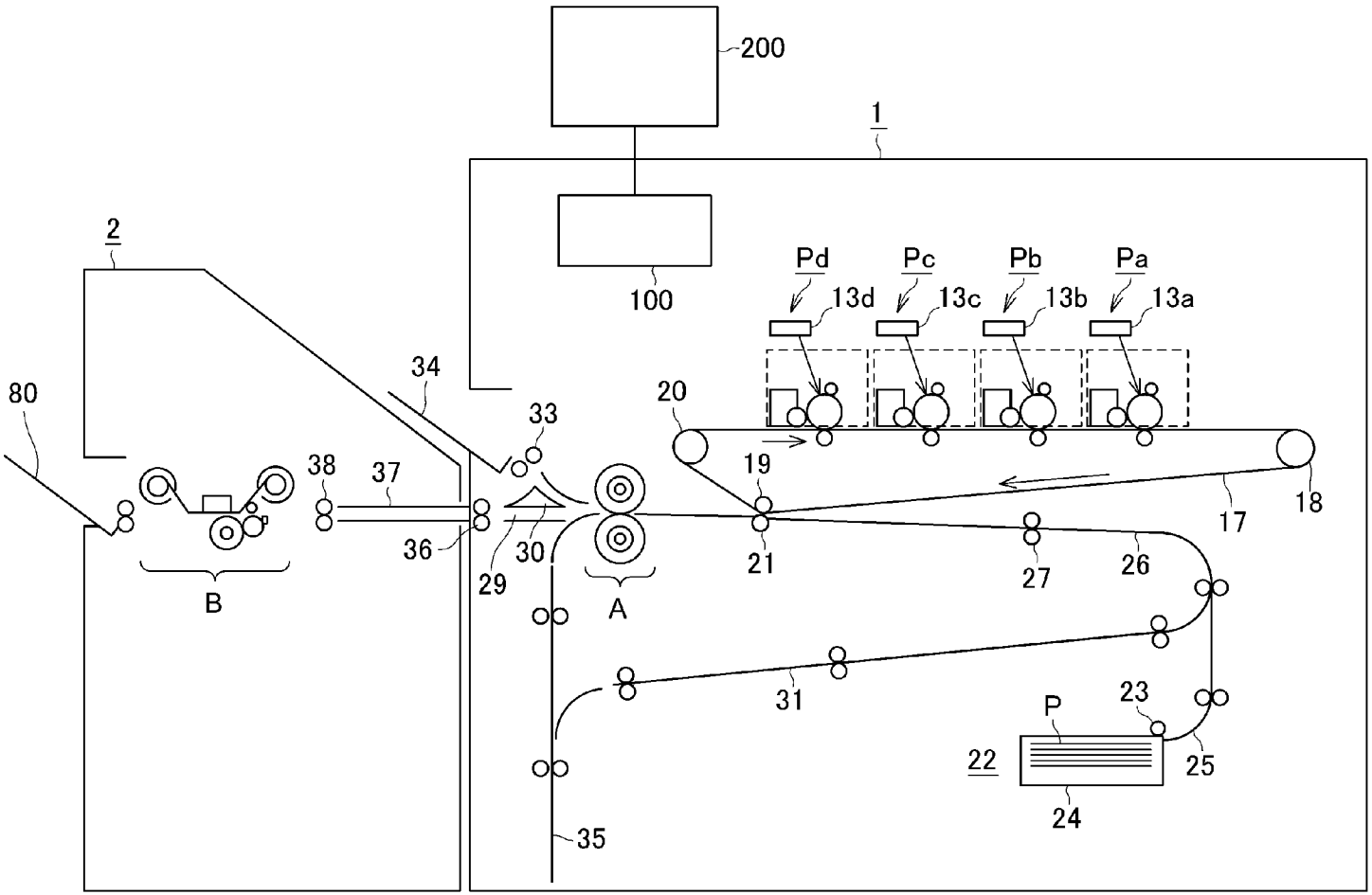
FIG. 1 is a schematic sectional view of the image forming apparatus in the first preferred embodiment of the present invention at a plane parallel to the recording medium conveyance direction, and shows the general structure of the apparatus.

First, referring to FIG. 1, the general structure of the image formation unit is described. Designated by a referential code 1 in the drawing is the main assembly 1 (which hereafter may be referred to simply as apparatus main assembly) of the image formation unit. Designated by a referential code 2 is a gloss changing unit, which is in connection to the print outlet side of the apparatus main assembly 1. The gloss changing unit 2 is independent from the image formation unit 1, and is an optional part of the image forming apparatus. It can provide a sheet of various recording medium with various levels of gloss. In this embodiment, the combination of the image formation unit and gloss changing device is referred to as an "image forming apparatus". The gloss changing unit 2 may be installed in the image formation unit 1.

The apparatus main assembly 1 is an electrophotographic full-color image forming apparatus based on four primary colors (color image forming apparatus of so-called tandem type). It has four image forming stations Pa-Pd which correspond one for one to the four primary colors (yellow, magenta, cyan, and black toners). The apparatus main assembly 1 is in connection to an external host apparatus 200 such as a color image reading apparatus, a personal computer, and the like. It is from the host apparatus 200 in connection to the apparatus main assembly 1 that various information signals such as those of the image formation data are inputted into the apparatus main assembly 1. The control section 100 of the apparatus main assembly 1 controls an image formation sequence in response to the various information signals inputted from the host apparatus 200.

Figure 6:
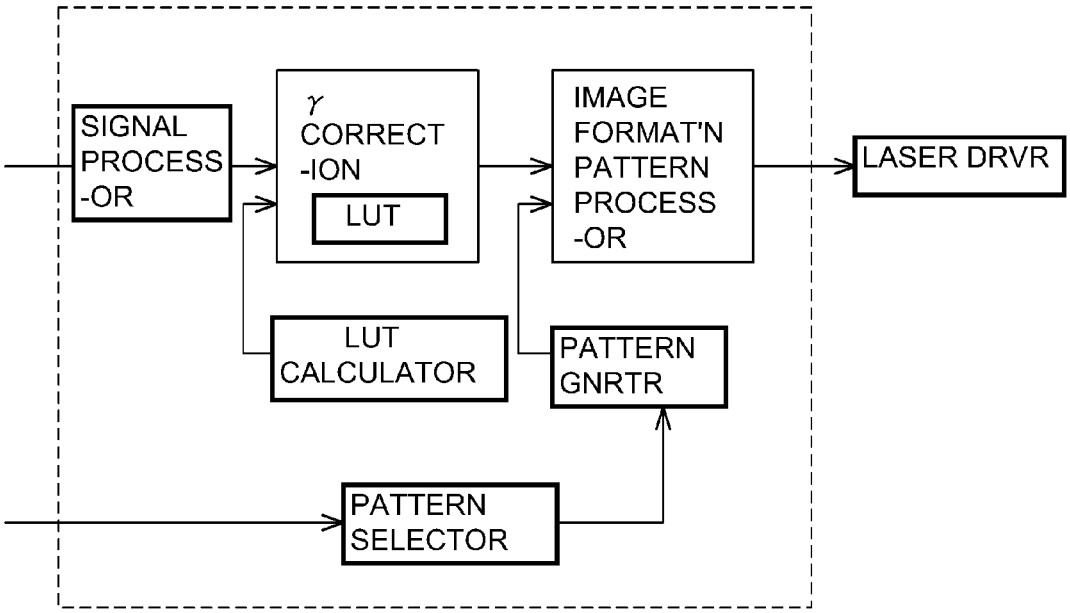
FIG. 6 is a block diagram of the control section of the image forming apparatus in the first preferred embodiment.

Next, referring to FIG. 6, the flow of the image formation sequence carried out by the apparatus main assembly 1 is described. The signals outputted from the host apparatus 200 are adjusted in terms of resolution, converted into 8 bit (256 gradations) brightness signals, and are inputted into the illustrated signal processing section of the apparatus main assembly 1. Then, the brightness signals are converted into density signals in the signal processing section with the use of one of the known algorithms, and then, are corrected in density (γ conversion) in the γ correction section.

Thereafter, in the image formation pattern processing portion, in each of the four image forming stations, a screening is carried out with the use of a known binary or multi-value image formation pattern processing method, which is selected by a user or the pattern selecting portion of the control section 100, whereby the image formation pattern is digitized in the binary or multi-value form, and this information is transmitted to the laser driver of each image forming station. Incidentally, as the known method for digitizing the image formation pattern in the binary or multi-value form, the dot concentration dither method, error dispersion method, etc., are employed.

Figure 7:
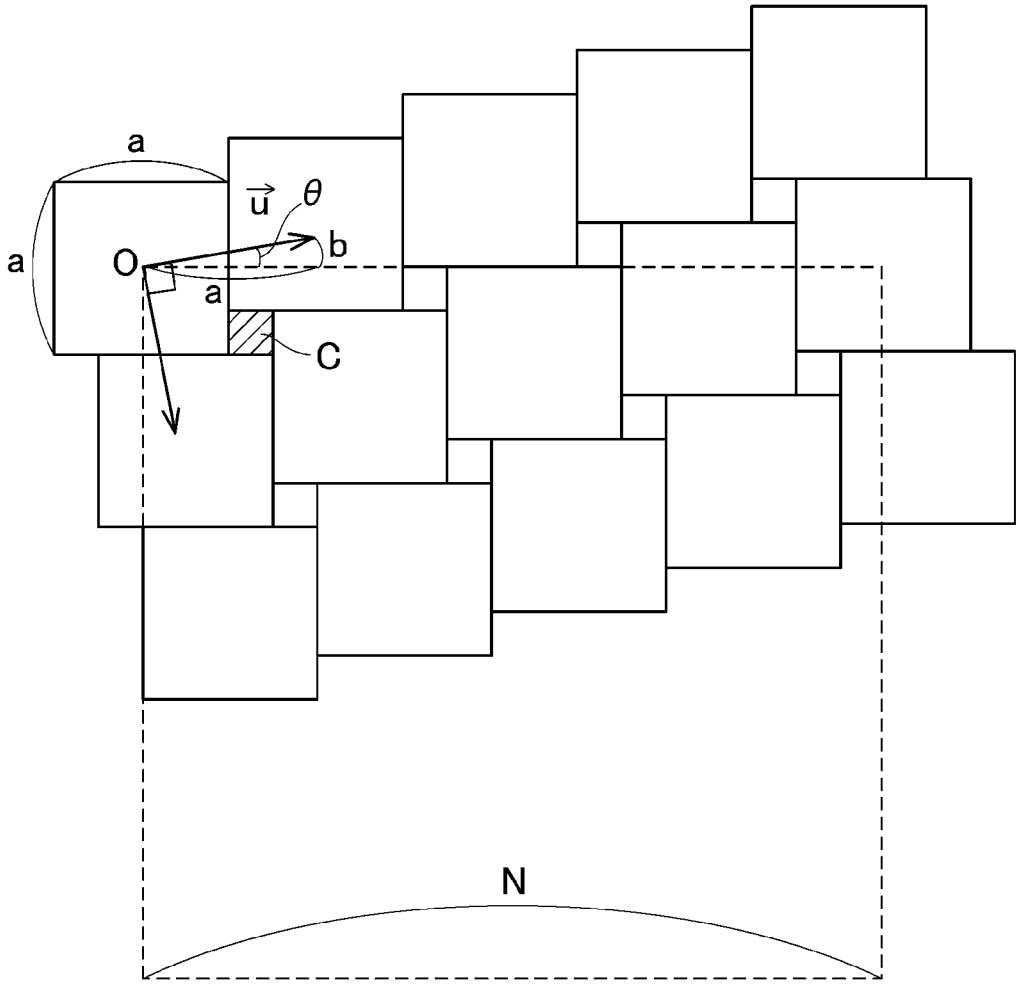
FIG. 7 is a drawing of an example of a pattern of a halftone screen.

Each image forming station forms a halftone screen having such a pattern as the one shown in FIG. 7. As is evident from FIG. 7, a halftone screen having a preset angle can be formed by aligning base units of the halftone screen, which is made up of (a×a) pixels, so that each pixel is displaced from its adjacent pixel in a preset direction by a preset amount u (displacement vector u). If the amount u is (a, b) (u=(a, b)), the value of the screen angle θ is obtainable from a mathematical equation: $\theta=\tan^{-1}(b/a)$. To express the square threshold value matrix size N, which is equivalent to a single cycle of the halftone dot, N=LCM(a, b)×(b/a+a/b). Using (a, b), LCM(a, b) is the least common multiple. From the standpoint of realizing a dither pattern having a desired angle, and also, minimizing the hardware load, it is necessary to use as small a matrix as possible. Incidentally, the concrete settings for the screen processing will be described along with each of the following embodiments.

After the formation of the halftone screen by the control section 100, the image signals are sent as output signals to each scanner unit 13. In the case of a multi-value halftone screen, the scanner 13 is driven so that the beam of laser is modulated with image signals, using a known modulation method such as PWM (pulse width modulation).

Figure 2:
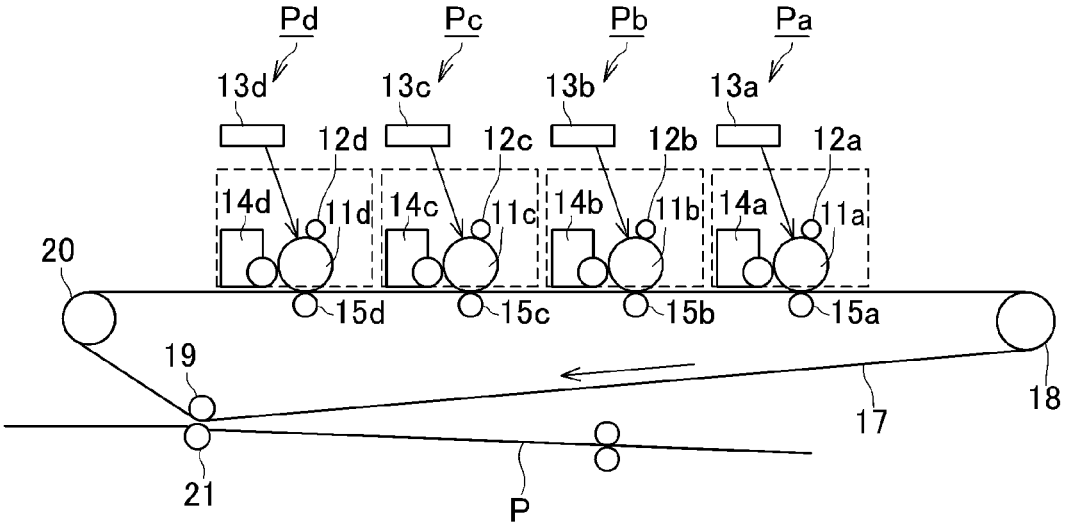
FIG. 2 is a schematic sectional view of the image formation unit in the first preferred embodiment at a plane parallel to the recording medium conveyance direction, and shows the general structure of the unit.

FIG. 2 is an enlarged schematic sectional view of the image forming portions of the image forming apparatus in the first embodiment, and shows the general structure of the image forming portions. The image formation sequence carried out by the image forming apparatus in this embodiment is as follows: The photosensitive drums 11 (11*a*, 11*b*, 11*c* and 11*d*) are rotated in the counterclockwise direction of FIG. 2 at a preset speed. As they are rotated, the peripheral surfaces of the photosensitive drums 11 (11*a*, 11*b*, 11*c* and 11*d*) are uniformly charged to a preset potential level by the primary charging devices (12*a*, 12*b*, 12*c* and 12*d*), respectively. Then, the charged peripheral surface of each photosensitive drum 11 is scanned by (exposed to) the beam of laser light projected from the corresponding scanner 13 (13*a*, 13*b*, 13*c* or 13*d*). Consequently, an electrostatic latent image is effected on the peripheral surface of each photosensitive drum 1.

Thereafter, the latent images on the photosensitive drums 11 are provided with toner by the developing devices 14 (14*a*, 14*b*, 14*c* and 14*d*), one for one, whereby they are developed into visible images (images formed of toner). Then, the toner images on the photosensitive drums 11 are sequentially transferred in layers from the photosensitive drums 11 (11*a*, 11*b*, 11*c* and 11*d*) onto an intermediary transfer belt 17, in the nips between the photosensitive drums 11 and corresponding primary transfer rollers 15 (15*a*, 15*b*, 15*c* and 15*d*). Consequently, a full-color image is effected on the intermediary transfer belt 17.

The toner particles which were not transferred (primary transfer) onto the intermediary transfer belt 17, that is, the toner particles remaining on the peripheral surface of the photosensitive drum 11, are removed by an unshown cleaner, or through the development/cleaning process. The order in which the yellow, magenta, cyan, and black toner image forming stations are arranged is optional. That is, it may be altered according to image forming apparatus design. Further, which toner is to be used to form the topmost image of a full-color image is determined based on the inputted tone of the image to be formed.

The intermediary transfer belt 17 is suspended and kept stretched by rollers 18, 19, and 20 so that it can be circularly moved. After the transfer of the toner images onto the intermediary transfer belt 17, the toner images are moved to the nip (second transfer station) between a secondary transfer roller 21, and the roller 19 which opposes the second transfer roller 21 across the intermediary transfer belt 17, and are moved through the nip. As the toner images are moved through the nip, they are transferred (secondary transfer) from the intermediary transfer belt 17 onto a sheet P of recording medium. The toner particles which were not transferred (secondary transfer) onto the sheet P, that is, the toner particles remaining on the intermediary transfer belt 17 after the secondary transfer, are removed by an unshown cleaning device.

It is from a recording sheet feeding station 22 that the sheet P of recording medium is conveyed. The sheet feeding station 22 is in the bottom portion of the apparatus main assembly 1, and is provided with a space for a sheet feeding cassette 24. As an image formation start signal is inputted into the apparatus main assembly 1, the sheets P of recording medium in the sheet feeding cassette 24 begin to be fed one by one into the apparatus main assembly 1. Then, each sheet P of recording medium is conveyed through sheet conveyance passages 25 and 26 to where a pair of registration rollers 27 are present. Then, each sheet P is conveyed to the second transfer station by the pair of registration rollers 27. Further, the illustrated image formation unit has a recording medium conveyance passages for two-sided image formation. That is, it has a sheet passage 35 for turning over a sheet P of recording medium after the fixation of the toner image on the sheet P by a fixing device A, and a sheet passage 31 for conveying the sheet P to the second transfer station for the second time after the sheet P is turned over.

After the transfer of a toner image onto the sheet P of recording medium, the sheet P is separated from the intermediary transfer belt 17 with the use of the curvature of the intermediary transfer belt 17, and then, is conveyed to the fixing device A, in which the sheet P and the toner image thereon are subjected to heat and pressure by the fixing device A. Thus, the toner image becomes fixed to the surface of the sheet P. When the image forming apparatus is not in the gloss changing mode, the sheet P is discharged from the apparatus main assembly 1 onto a first delivery tray 34 by a pair of the first discharge rollers 33 after the fixation of the toner image to the sheet P. When the image forming apparatus is in the gloss changing mode, the sheet P is sent into the gloss changing unit 2 by a pair of second discharge rollers 36 through a sheet passage 29, which is the direct sheet passage to the gloss changing device B. Whether the sheet P is discharged onto the delivery tray 34, or conveyed to the gloss changing unit B, is controlled by a flapper 30 which is under the control of the control section 100.

<1-2: General Structure of Gloss Changing Unit>

Figure 3:
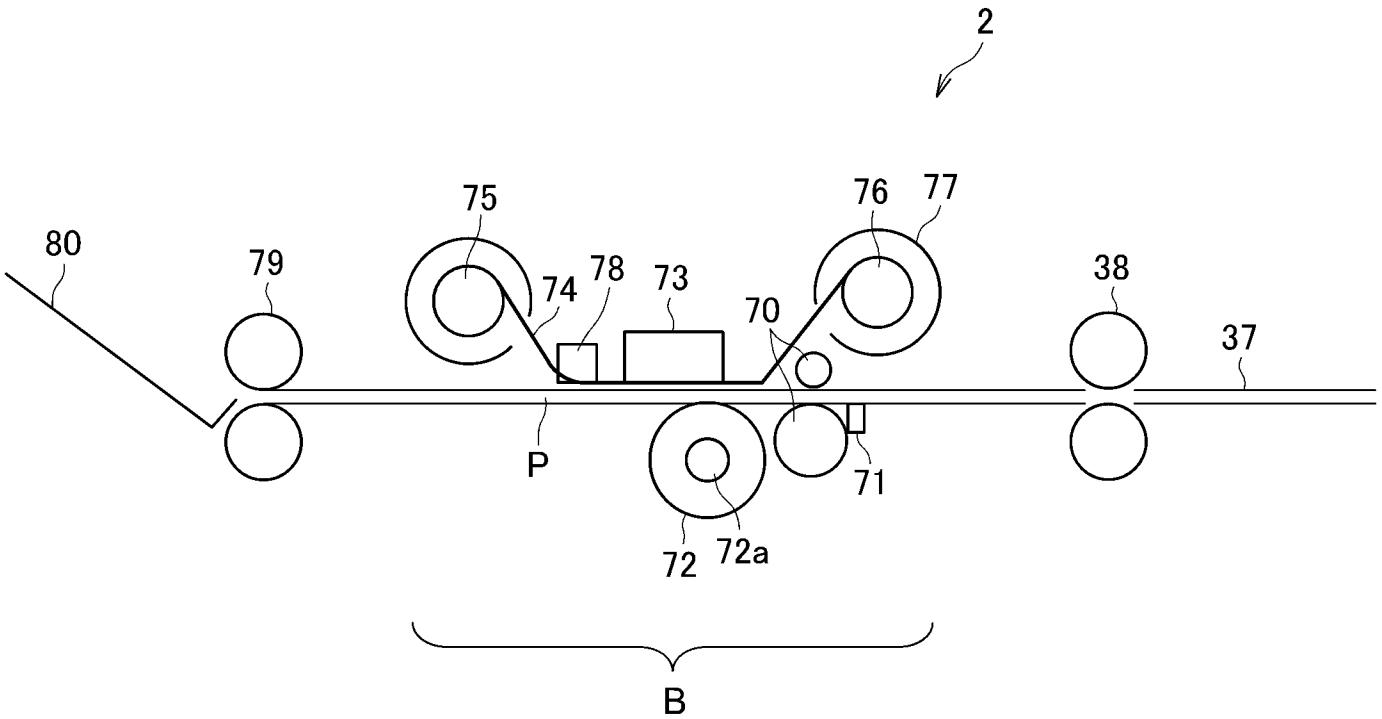
FIG. 3 is a schematic sectional view of the gloss changing unit in the first preferred embodiment at a plane parallel to the recording medium conveyance direction, and shows the general structure of the unit.

Next, referring to FIG. 3, the general structure of the gloss changing device B is described. The gloss changing device B is a device capable of partially or entirely changing a print, that is a combination of the sheet P and the fixed toner image thereon, in gloss by subjecting the print to a heating-cooling-separating process. Designated by a referential code 38 is a pair of recording medium conveyance rollers, which feed a print into the gloss changing device B after the print is conveyed from the image formation unit 1 to the rollers 38 through the sheet conveyance passage 37. Designated by a referential code 70 is a pair of rollers, which are capable of conveying the print (sheet P) forward into the gloss changing area of the gloss changing device B, or backward from the gloss changing area, in coordination with the sheet conveyance rollers 38, by pinching the print (sheet P). Further, designated by a referential code 71 is a sensor for detecting the leading edge of the print (sheet P) when the print is conveyed into the gloss changing device B so that the portion of the print (sheet P), which is to be changed in gloss, is positioned where the portion can be changed in gloss.

Further, designated by a referential code 72 is a platen roller (pressure applying member), which is on the opposite side of the recording medium conveyance passage from the gloss changing area of the gloss changing device B. Designated by a referential code 73 is a thermal head (heating member) having multiple heating elements which can be partially or entirely activated according to the gloss change information for the print. The platen roller 72 and thermal head 73 oppose each other with the presence of the recording medium conveyance passage between the roller 72 and head 73. Further, designated by a referential code 74 is a sheet of transfer film which the thermal head 73 contacts. Since the platen roller 72 is pressed against the thermal head 73 with the presence of the transfer film 74 between the roller 72 and head 73, there is a heating nip between the platen roller 72 and transfer film 74.

Further, designated by referential codes 75 and 76 are shafts for taking up, and feeding, respectively, the transfer film 74. Designated by a referential code 77 is a cassette in which the transfer film 74 is stored. Designated by a referential code 78 is a separating member for separating the transfer film 74 from the print (sheet P of recording medium) after the transfer film 74 is pressed upon the sheet P by the thermal head 73. Further, designated by a referential code 79 is a pair of discharge rollers for discharging the print (sheet P) out of the gloss changing unit 2. Designated by a referential code 80 is a delivery tray. Next, the abovementioned essential members, of which the gloss changing unit 2 is made are described in more detail.

(Thermal Head)

Figure 4:
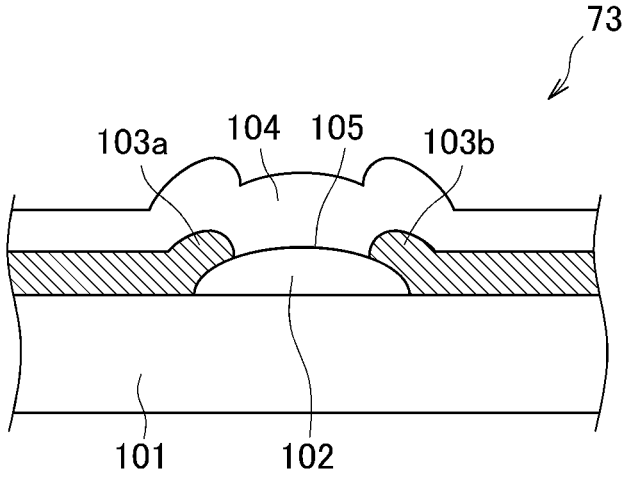
FIG. 4 is a schematic sectional view of one of the heat generating elements of the thermal head in the first preferred embodiment, and shows the general structure of the heat generating element.

The thermal head 73 is for heating the toner image on the sheet P of recording medium through the transfer film 74. FIG. 4 shows the general structure of the thermal head 73, more specifically, the structure of one of its heat generating elements. The thermal head 73 has a substrate 101, glaze (heat retaining layer), a common electrode 103*a*, a lead electrode 103*b*, and heat generating elements 105 (heat generating resistors), and a protective film 104 (overcoat layer). The substrate 101 is formed of alumina or the like. The glaze 102, common electrode 103*a*, lead electrode 103*b*, and heat generating elements 105 are formed on the substrate 101 by printing. Each heat generating element 105 is between the common electrode 103*a* and lead electrode 103*b*. The electrodes 103*a* and 103*b* and heat generating element 105 are covered with the protective film 104.

Further, the thermal head 73 is provided with structural components other than the abovementioned ones: it has a driver circuit for selectively supplying the heat generating elements 105 with electrical power to cause them to generate heat, a heat radiating plate for radiating the excessive amount of heat from the thermal head 73 after the application of heat to the sheet P of recording medium, toner images thereon, etc.

The thermal head 73 used for this embodiment is 300 dpi in heat generating element density, 300 dpi in recording density; 30 V in driving voltage, and 5000Ω in average resistance value of the heat generating elements. However, this embodiment is not intended to limit the present invention in terms of the specification of the thermal head 73.

Figure 5:
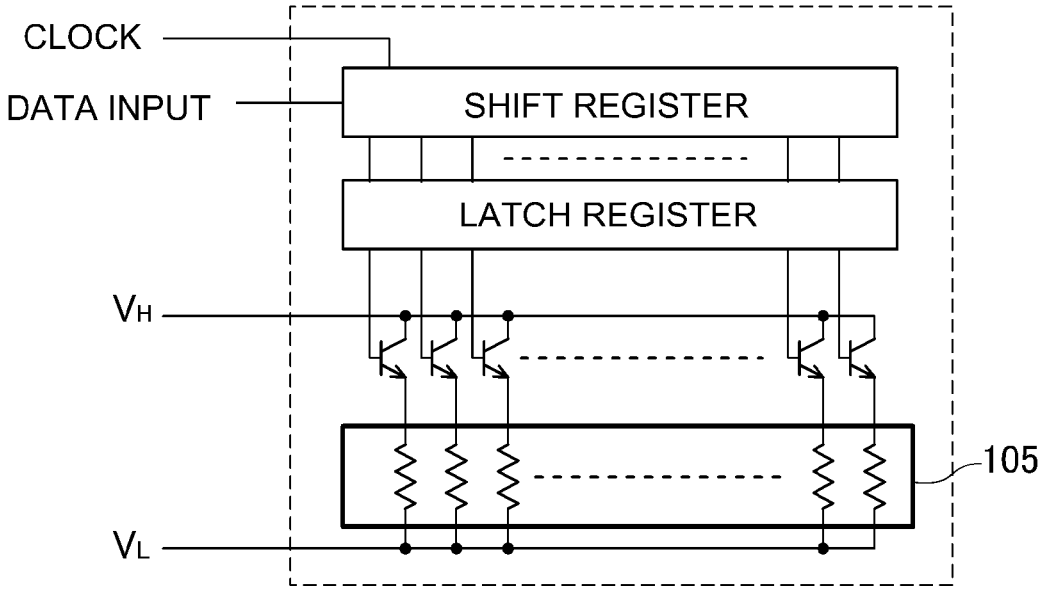
FIG. 5 is a schematic diagram of the thermal head driving circuit in the first preferred embodiment.

Shown in FIG. 5 is the general diagram of the driver circuit of the thermal head 73. There are multiple lines of heat generating resistors, multiple lines of electrodes VH positioned on one side of each line of heat generating resistors, and multiple lines of electrodes VL positioned on the other side of each line of heat generating resistors. Further, the thermal head 73 is provided with a driver IC comprising a group of registers which transfer and/or hold the data for each line of heat generating resistors. The driver IC may be on the same aluminum substrate as the abovementioned one, or on a wiring substrate separate from the abovementioned one. Here, a "line of heat generating resistors" means such a line of heat generating resistors that is perpendicular to the recording medium conveyance direction.

(Platen Roller)

The platen roller 72 is a rubber roller. It is made up of a shaft 72*a*, and a surface layer formed of hard rubber which is relative high in friction coefficient, for example, silicon rubber or the like. It is supported by the frame of the gloss changing device B, by its shaft 72*a*. The gloss changing device B is structured so that as the platen roller 72 is driven by an unshown driving power source, the transfer film 74 is moved in the same direction as the sheet P of recording medium.

(Transfer Film)

The transfer film 74 is in the form of a roll, and is fitted around the film supply shaft 76. The gloss changing device B is structured so that as the transfer film 74 is taken up, as necessary, by the film take-up shaft 75, a fresh portion of the transfer film 74 is fed into the gloss changing station, which includes the thermal head 73. Since the transfer film 74 has to be capable of partially and highly efficiently heating the sheet P of recording medium, it is formed of thin and flexible material. That is, the transfer film 74 is desired to be no less than 40 μm in thickness. From the standpoint of gloss changing efficiency alone, the transfer film 74 may be made to be as thin as 2 μm. However, from the standpoint of strength, the transfer film 74 is desired to be no less than 4 μm in thickness.

Further, the transfer film 74 is required to have such surface properties (gloss) that can give photographic gloss to the sheet P of recording medium and the toner image thereon. Therefore, it is desired to have a certain amount of stiffness. For example, if the substances listed below are used as the material for the transfer film 74, the transfer film 74 is desired to be no less than 8 μm in thickness. Further, regarding the material for the transfer film 74, the transfer film 74 is required to be resistant to the heat from the thermal head 73. Therefore, a substance, such as polyimide, the heat resistance of which exceeds 200° C., is desired as the material for the transfer film 74. However, ordinary resin film, such as PET film, may be used as the material for the transfer film 74, although the PET film or the like ordinary film suffers from thermal hysteresis. In this embodiment, 1) PTE film which is 8 μm in thickness, or 2) PET film with a coated parting film layer, which is 9 μm in thickness, was used as the material for the transfer film 74.

Out of the two substances mentioned above as the materials for the transfer film 74, 2) is provided with a coated parting layer. The parting layer formed on the PTE film by coating is low in surface energy, and is for making it easier for the transfer film 74 to separate from the sheet P of recording medium. In the case of a technology, such as the one to which the present invention is related, which is for providing a surface of a sheet P of recording medium with a desired amount of gloss and/or a desired kind of gloss, by transferring the surface texture of the transfer film 74 onto the surface of the sheet P, the transfer film 74 and sheet P smoothly separate from each other, from the standpoint of how accurately the surface texture of the transfer film 74 is transferred onto the surface of the sheet P. This is why the transfer film 74 is coated with a substance which is superior in parting properties.

As the substance to be coated on the substrate film of the transfer film 74 to make the transfer film 74 excellent in parting properties, fluorinated resin, silicone resin, and the like, for example, can be used. Incidentally, the methods for forming a parting layer on the substrate layer of the transfer film 74 do not need to be limited to a coating method such as the abovementioned one. That is, the method for providing the transfer film 74 with the parting layer may be a method other than coating, as long as the method can make it possible for the surface texture of the transfer film 74 to be precisely transferred onto the sheet P and the toner image thereon. In this embodiment, in order to provide the recording sheet P and the toner image thereon with a flat surface like the surface of an ordinary photograph, the substrate film of the transfer film 74 is coated with one of the abovementioned substances.

Further, the back surface (opposite surface from surface which faces thermal head 73) of either of the above listed substrate films form of 1) and 2) is provided with a stick prevention layer, which is for minimizing the amount of mechanical friction between the transfer film 74 and thermal head 73. Thus, the stick prevention layer is required to be close in properties to the above-mentioned parting layer formed by coating on the top surface of the substrate layer of the transfer film 74. As the substances which can satisfy this requirement, fluorinated resin, silicone resin, etc., which are similar to the one used as the material for the parting layer, can be listed.

The transfer film 74 is for transferring its surface texture onto the sheet P of recording medium and the toner image thereon. Therefore, as long as it is made of highly glossy flat film, it can provide the surface of the sheet P and the toner image thereon with highly glossy texture such as the surface texture of an ordinary photograph. On the other hand, if the transfer film 74 is made of film matted by sandblasting or the like method, film having a special surface pattern, or the like, it can be used to inversely transfer its surface texture and/or pattern onto a print which is to be processed by the gloss changing device. That is, a sheet of recording medium and the toner image thereon can be given one of various surface texture and/or patterns by choosing a transfer film 74 which matches in surface texture and/pattern to the desired surface texture and/or pattern for the print. For example, such a surface texture as that of a sheet of silk cloth, Japanese paper, embossed paper, etc., can be transferred onto the recording sheet P and the toner image thereon. Further, it is possible to provide the recording sheet P and the toner image thereon with a geometric pattern, a lattice, etc. In other words, it is possible to transfer one or a mixture of surface textures different in appearance, onto recording medium and the toner image thereon. Further, it is possible to provide the transfer film 74 with a geometric surface structure which is in the order of 1 μm or less in dimension, in order to transfer a holographic texture (holographic color) onto the recording sheet P and the toner image thereon. The thermal head in this embodiment is enabled to be partially heated to change in gloss a selected part or parts of the recording sheet P and the toner image thereon. Therefore, it can be equipped with various transfer films 74 different in surface texture and/or pattern so that it can transfer various surface textures and/or patterns, including holographic texture (holographic color) onto the recording sheet P and the toner image thereon.

(Separating Member)

The separating member 78 plays two roles, that is, a role of cooling the transfer film 74 and a role of separating the transfer film 74 from the sheet P of recording medium, with the use of film curvature. It is made of such a metal as SUS. The surface of the separating member 78, which comes into contact with the transfer film 74, is provided with a curvature (separation curvature) which is equivalent to the curvature of a circle which is 1 mm in radius. It is made small enough in separation curvature to ensure that it can separate the transfer film 74 from the recording sheet P and the toner image thereon.

The separating member 78 has to be able to prevent its transfer film separating portion (unshown) from excessively increasing in temperature. Therefore, it is desired to be provided with a cooling system, such as a cooling fan. That is, it is desired that the gloss changing device is structured so that the temperature of the transfer film separating portion of the separating member 78 is monitored by multiple thermistors, different in location, and the temperature of the separating portion is kept no higher than the target cooling level, by the cooling mechanism. In consideration of the Tg (glass transition temperature level: temperature level at which polymer begins to change in state from state of glass to state of rubber) and melting points of the toner on the sheet P of recording medium, and those of the surface layer, such as overcoat, made of resin, the target temperature level for cooling is desired to be roughly Tg+15° C., preferably, no more than Tg. Further, some sheets of colored recording medium may contain wax or the like in addition to resinous substances, coloring agents, etc., in their surface layer. In a case where a sheet of such recording medium is used as the recording medium for an image forming operation, the target level of the cooling temperature is desired to be set to be no higher than the melting point of the wax. If it is impossible to determine the properties of the sheet P of recording medium, the target level of the cooling temperature is desired to be set to a very low level, for example, the level of the room temperature, more specifically in a range of 30-50° C.

<Operation of Image Forming Apparatus>

The image forming apparatus in this embodiment can operated in the first recording mode (recording mode A) and the second recording mode (recording mode B), which are selectable by a user. In the first recording mode, the image forming apparatus outputs a print (sheet P of recording medium and toner image thereon) without changing the print in gloss, whereas in the second recording mode, the image forming apparatus outputs a print after it changes the print in gloss with the use of its gloss changing unit 2.

The image formation sequence of the image forming apparatus is as follows: First, the abovementioned image forming stations Pa-Pd are sequentially driven, whereby monochromatic toner images, different in color, are sequentially transferred in layers onto the intermediary transfer belt 17. If the recording mode A, that is, the mode in which a print is discharged without being changed in gloss, is selected by a user, the pattern in which a halftone screen is created for forming the topmost toner layer of the multilayer image on a sheet P of recording medium is to be selected by the user, or is automatically selected by the control section 100 from among the patterns stored in the control section 100.

If the recording mode B, that is, the mode in which both the image forming sequence and gloss change sequence are carried out, is selected by a user, the control section 100 controls the image formation unit in such a manner that the image forming station for forming the topmost toner image (layer) forms the topmost image using one of the following image formation pattern processing method for creating the halftone screen for the topmost toner image. That is, the halftone screen for the topmost toner image is created with the use of an image formation pattern processing method other than the line growth dither method, more specifically, an image formation pattern processing method of the dot growth type, such as the dot concentration dither method, error dispersion dither method, or the like. Then, the topmost toner layer is formed with the use of the thus created halftone screen. The details of the settings are described later.

When the image forming apparatus is in the recording mode A, that is, one of the two operational modes selectable by a user, the control section 100 controls the flapper position switching mechanism to change the attitude of the flapper 30 (which is on downstream side of fixing device A in terms of recording medium conveyance direction) so that the flapper 30 guides the sheet P of recording medium into the upward recording medium passage 32. Thus, as the sheet P comes out of the fixing device A, it is guided into the upward recording medium passage 32, and then, is discharged, as a finished print, by the pair of first discharge rollers 33 into the first delivery tray 34 of the apparatus main assembly 1.

When the image forming apparatus is in the recording mode B (gloss changing mode) selected by a user, the control section 100 keeps the flapper 30 in the attitude in which the flapper guides the sheet P toward a recording medium passage 29 which guides the sheet P straight into the gloss changing device B. Thus, after coming out of the fixing device A, the sheet P is guided toward the recording medium passage 29, and is introduced into the gloss changing unit 2 by the pair of second discharge roller 36 from the apparatus main assembly 1. Next, referring to FIG. 3, after the sheet P is introduced into the gloss changing device 2 B, it is conveyed further through the recoding medium conveyance passage 37, the interface between a pair of recording medium conveyance rollers 38, and introduced into the gloss changing device B, in which it is changed in gloss. Then, it is discharged by a pair of discharge rollers 79, into a second delivery tray 80, that is, the delivery tray of the gloss changing unit 2.

That is, when the image forming apparatus is in the recording mode A, the sheet P of recording medium, on which an unfixed toner image is present, is subjected only once to the fixation process by the fixing device A, and then, is discharged as a finished print into the first delivery tray 34. On the other hand, when the image forming apparatus is in the recording mode B, the sheet P, on which an unfixed toner image is present, is thermally processed twice (fixed twice). That is, it is processed (first fixation) by the fixing device A, and then, is thermally processed for the second time to be changed in gloss, by the gloss changing device B. Then, it is discharged, as a finished print, that is, a print, the specific area or areas of which have been changed in gloss (increased in gloss, for example), into the second delivery tray 80. The fixation process carried out by the image forming apparatus in this embodiment when the image forming apparatus is in the recording mode A is roughly the same as the known fixation process carried out by an ordinary electrostatic image forming apparatus.

Next, the gloss changing sequence carried out by the gloss changing device B when the image forming apparatus is in the recording medium B, that is, the recording mode in which a print is changed in gloss after coming out of the fixing device A, is described in detail. First, the dimension of the recording sheet P in terms of the recording medium conveyance direction is calculated based on the point in time when the leading edge of the recording sheet P passes by a leading edge sensor 71 while the sheet P is conveyed to the gloss changing process starting position shown in FIG. 3, and the like information.

After being moved past the leading edge sensor 71, the recording sheet P is conveyed to the gloss changing portion, in which the platen roller 72 and thermal head 73 oppose one another across the recording medium conveyance passage. Then, the sheet P is conveyed through the gloss changing portion, with the toner image bearing surface of the recording sheet P being kept in contact with the transfer film 74, while the selected heat generating resistors of the thermal head 73 are generating heat. Consequently, the surface texture of the transfer film 74 is transferred onto the surface of the sheet P and the surface of the toner image(s) on the sheet P. That is, the surface of the sheet P and the image thereon are changed in gloss. Then, the print is separated from the transfer film 74 by the separating member 78, and is discharged.

In the gloss changing operation, the shaft 76 (supply shaft) of a roll of the transfer film 74 in the transfer film cassette 77, and the take-up roller 75, are rotated by the rotation of the pair of recording medium conveyance rollers 70 so that the transfer film 74 is conveyed by the distance equal to the length of the sheet P. Further, the gloss changing device B is structured so that as the leading edge sensor 71 detects that the sheet P has been conveyed to the gloss changing process starting position, the platen roller 72 is pressed against the thermal head 73.

Thus, in a gloss changing operation, the platen roller 72 is rotated, with the transfer film remaining sandwiched between the platen roller 72 and thermal head 74. As the platen roller 72 is rotated, the transfer film supply roller 76 and transfer film take-up roller, which do not have their own driving power source, are rotated by the rotation of the platen roller 72, whereby the transfer film 74 is conveyed by a length equal to the length of the recording sheet P while being taken up by the length equal to the length of the recording sheet P. As the gloss changing process ends, the platen roller 72 is moved away from the thermal head 73. Lastly, the print is discharged into the delivery tray 80 by being guided by the pair of discharge rollers 79, ending the gloss changing operation.

The gloss changing device B in this embodiment is structured so that the texture of the transfer film 74 can be transferred onto the surface of a print multiple times by reciprocally conveying the print by the pair of recording medium conveyance rollers 70. However, this embodiment is not intended to limit the present invention in terms of the structure of the gloss changing device B. For example, a gloss changing device may be structured so that it is provided with a platen drum, and so that a print can be subjected to a gloss changing process multiple times by rotating the drum multiple times. Further, a gloss changing device may be structured so that its platen roller is directly driven, and so that a print can be conveyed in only one direction and is changed only once in gloss. The speed at which a print is moved during the gloss changing process by the gloss changing device B in this embodiment is 50 mm/s.

To describe additionally about the control of a gloss changing process, during a gloss changing operation, the electrical power supplied in the form of pulses to the heat generating resistors is precisely controlled in pulse width or pulse count, according to the signal level (recording signal level) for the gloss change. As for the recording order (gloss changing order), each recording line is treated as one unit. Thus, as one unit (single line) of image is printed, the platen roller 72 is rotated by an angle equivalent to the width of a single line (unit), moving thereby the print while moving the transfer film 74 by the same distance as the print.

There are two methods for supplying the thermal head 73 with electrical pulses. One is to control the electrical pulses in width while keeping the pulses constant in frequency, and the other is to control the electric pulses in frequency while keeping them the same in width. The former is suitable for precisely controlling a print in gradation and density in which the print is outputted, but it makes complicated the control portion for controlling halftone. The latter adjusts the input in terms of gradation, by preparing (using) pulses constant in width, reducing thereby the load upon the halftone control portion. However, it requires a substantially greater number of pulses than the number of actual gradation levels, in order to yield a print which is precise in density. In this embodiment, the former is used to control the thermal head 73 in the amount of its heat generation in the intermediary heat range.

<1-4: Mechanism of Occurrence of Gloss Change Imperfection>

The inventors of the present invention earnestly studied the gloss imperfections which occurred to the topmost toner layer of the recording sheet P, along the line of pixel alignment, when a print was changed in gloss. The results of the studies revealed that the mechanism of the occurrence of the gloss imperfections error is as follows. Next, this mechanism is described in detail.

After a toner image formed on the recording sheet P by the image formation unit 1, was fixed by the fixing device A, and the resultant print was outputted from the image forming apparatus, the height of the toner image on the recording sheet P is a combination of the height of the toner layer (topmost toner layer) for achieving the density level correspondent to the density information of the image to be formed, and the height of the thermoplastic resin layers (toner layers under topmost toner layer). As a print (combination of recording sheet P and toner images thereon), such as the one described above, is subjected to a gloss changing process carried out by the gloss changing device B, the topmost toner layer comes into contact with the transfer film 74 in the gloss changing unit 2. Then, the print is conveyed, together with the transfer film 74, through the heating nip between the thermal head 73 and platen roller 72. As the print is conveyed, the predetermined portion or portions, of the print are selectively heated in the heating hip. That is, the print is changed in surface gloss as desired. Then, as the print is conveyed out of the heating nip, it cools down, and is separated from the transfer film 74.

Figure 12:
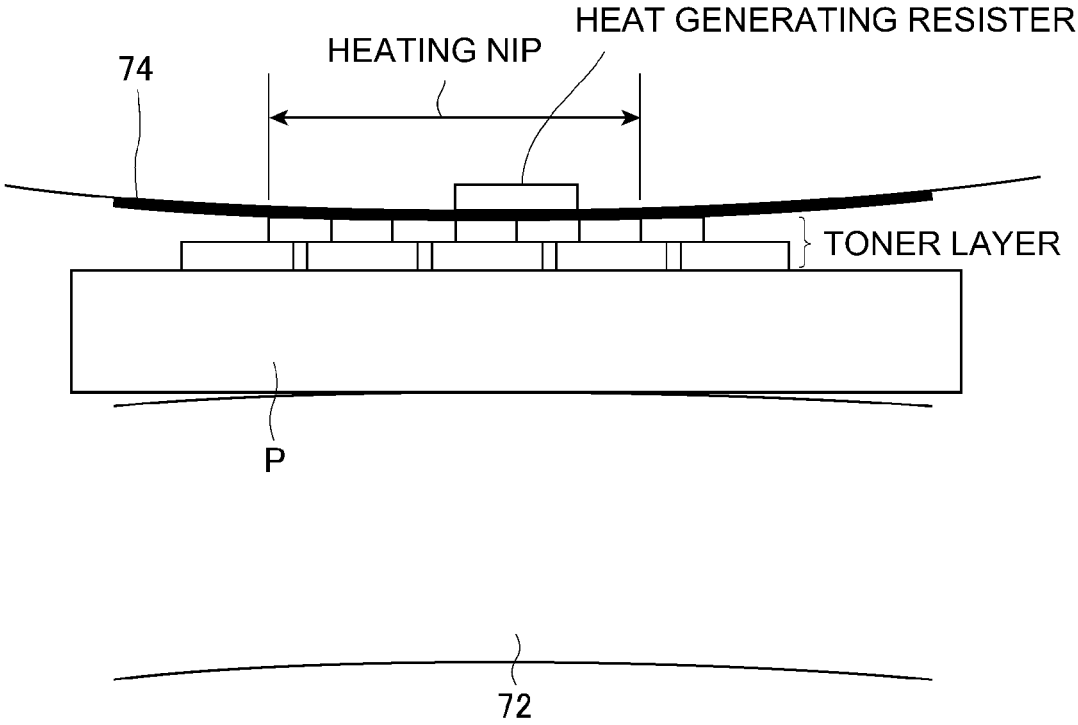
FIG. 12 is a drawing for describing one of the primary causes of the gloss imperfection.

FIG. 12 is an enlarged schematic sectional view of the heating nip portion of the thermal head 73, that is, the portion between the thermal head 73 and platen roller 72, while the print is changed in gloss by the thermal head 73. As the print (combination of recording sheet P and toner image thereon) is heated, the heat generated by each of the heat generating resistors of the thermal head 73 disperses in all directions from the center of the resistor. Further, since the print is being conveyed by the platen roller 72, the heating nip is made to slightly shift downstream relative to the line of heat generating resistors of the thermal head 73 in terms of the recording medium conveyance direction, as shown in FIG. 12. That is, the heating nip extends slightly downstream in terms of recording medium conveyance direction.

The measured dimension of the heating nip of the gloss changing unit 2 in this embodiment in terms of the recording medium conveyance direction was roughly 2 mm, which is substantially narrower than an ordinary fixing device. It may be reasonable to think that this setup is for the following reason. That is, the transfer film 74 of the gloss changing unit 2 is extremely thin, and therefore, its thermal capacity is extremely small compared to the thermal capacity of the combination of the recoding sheet P and the toner image thereon. Thus, it is not the entirety of the toner layer on the recording sheet P that is melted in the heating nip. That is, it is mostly the top layer of the multilayer toner image, which is closer to the transfer film 74 that changes the print in gloss by being deformed by being melted.

Figure 13:
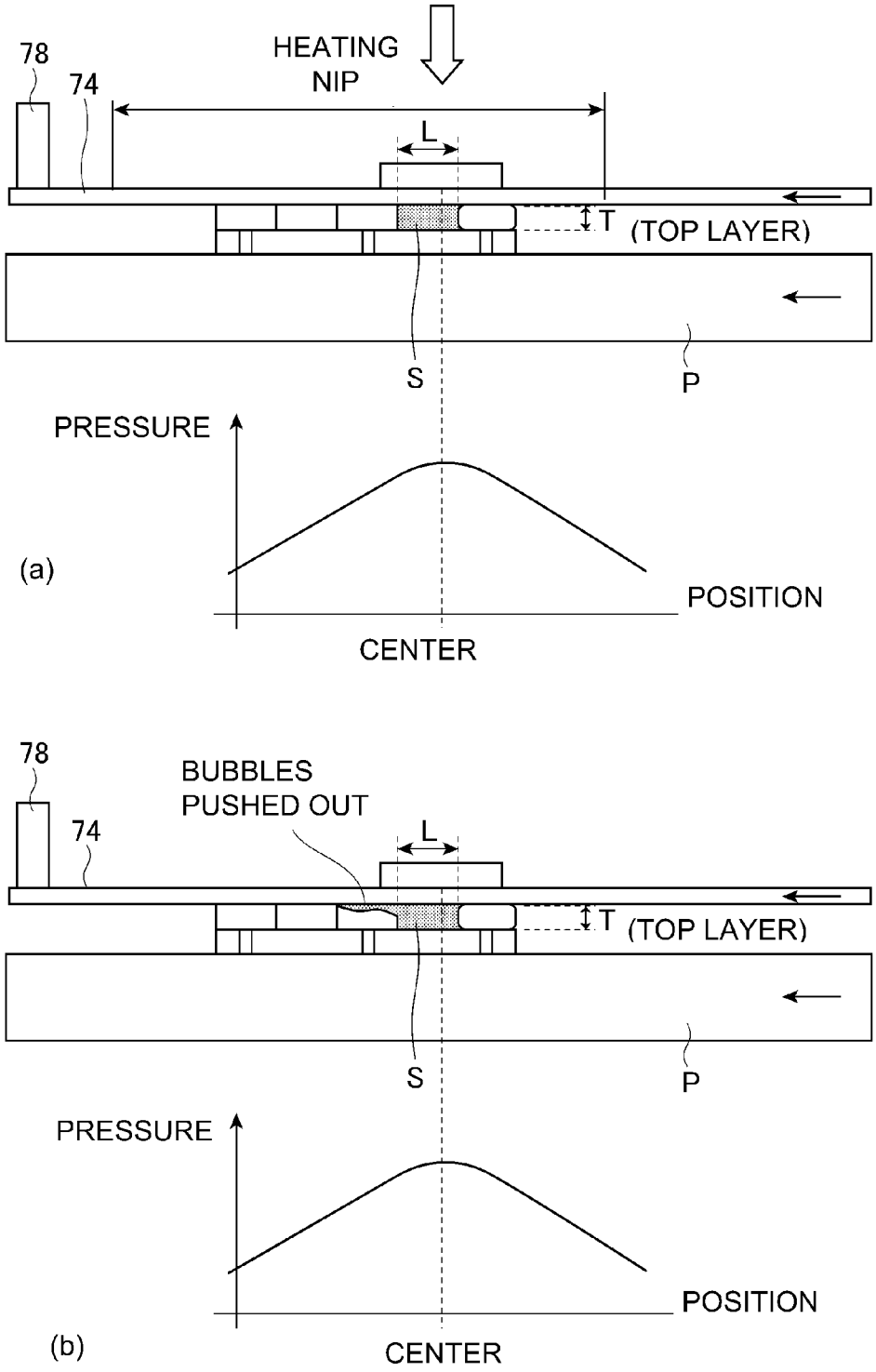
FIG. 13 is a drawing for describing the mechanism of the occurrence of a gloss imperfection.

FIG. 13(*a*) is a combination of an enlarged sectional view of the heating nip of the gloss changing unit 2 in this embodiment, and a graph which shows the pressure distribution of the heating nip. The earnest studies of the copies of image density patches which are unsatisfactory in gloss revealed that the frequency with which the gloss imperfections occur is affected by the picture element structure of the topmost layer of the multilayer toner image on the recording sheet P. Further, the studies revealed the conditions under which the gloss imperfections occur.

More concretely, referring to FIG. 13(*a*), it became evident that the gloss imperfections occur when the dimension L, in terms of the recording medium conveyance direction, of the portion surrounded by the topmost toner layer of the multilayer image and the layer immediately under the topmost layer is less than the dimension of the heating nip of the thermal head in terms of the recording medium conveyance direction. It revealed also that the frequency with which the gloss imperfections occur is affected by the image density of the topmost toner layer of the multilayer image, and also, the density of the toner layer of the multilayer toner image, which is under the topmost toner layer. Hereafter, the mechanism of the occurrence of the gloss imperfections is described in more detail.

Referring to FIG. 13(*a*), if the dimension L, in terms of the recording medium conveyance direction, of the area surrounded by the top most toner layer of a multilayer image, and the toner layer under the topmost toner layer, is less than the dimension of the heating nip of the thermal head in terms of the recording medium conveyance direction, there is a space S surrounded by the transfer film 74, topmost toner layer of the multilayer image, and the toner layer under the topmost toner layer. Thus, as the print is heated in the heating nip, the air and water vapor in the space S become highly pressurized and forces the space S to expand.

As the air and water vapor continue to be pressurized, it becomes impossible for the air and water vapor to remain in the space S. As a result, they cause the space S to expand downstream of the heating nip where the nip pressure is smaller than the upstream side, and burst out of the heating nip from the downstream side of the heating nip. Therefore, the transfer film 74 is separated from the print at a upstream point of the position of the separating member, by the air and water vapor, as they force themselves out of the space S downstream, even though the transfer film 74 and the melted topmost toner layer of the multilayer image on the recording sheet P are to remain adhered to each other until the arrival of the print at the position of the separating member, and then, are to be separated from each other after they cool down. As a result, the surface of the topmost toner layer becomes rough; the surface fails to acquire the intended surface texture.

Figure 14:
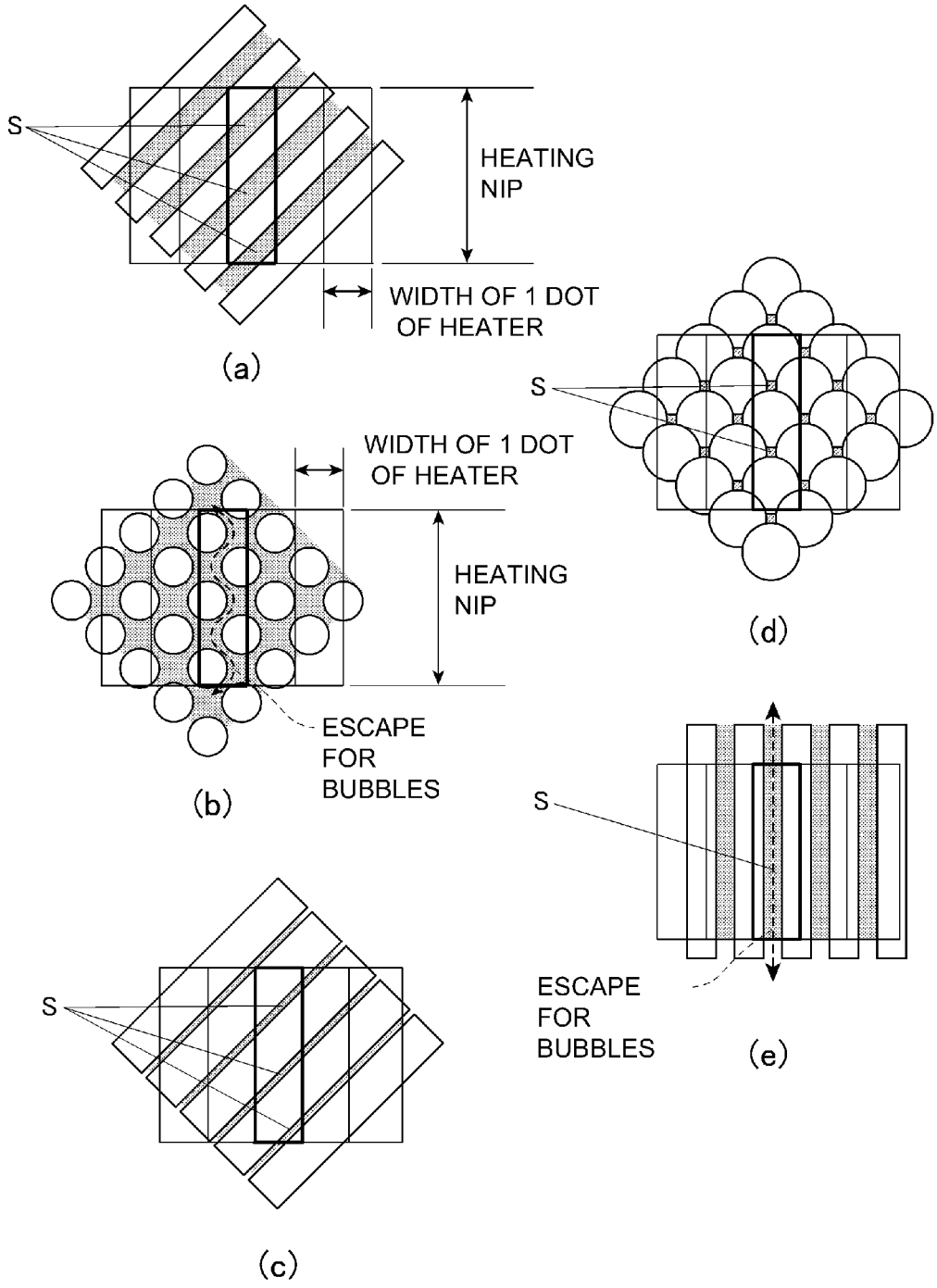
FIG. 14 is a drawing for describing the mechanism of the occurrence of a gloss imperfection.

FIGS. 14(*a*)-14(*d*) show the positional relationship among the topmost toner layer of the multilayer image on the recording sheet P, the toner layer of the multilayer toner image on the recording sheet P, which is under the topmost toner layer, and the heating nip, as seen from the direction indicated by a white arrow mark in FIG. 3(*a*), at a given point in time. FIGS. 14(*a*) and 14(*c*) show two examples, one for one, of the portion of a multilayer toner image whose topmost toner layer and layer thereunder were formed using a dither method of the line growth type, which is 45° in process angle. The print shown in FIG. 14(*a*) was intended to be 69% in image density, and the print shown in FIG. 14(*c*) was intended to be 90% in image density. FIGS. 14(*b*) and 14(*d*) show two examples, one for one, of a portion of a multilayer toner image whose topmost layer and layer thereunder were formed using a dither method of the dot growth type, which is 45° in process angle. The print shown in FIG. 14(*b*) was intended to be 60% in density, and the print shown in FIG. 14(*d*) was intended to be 90% in image density.

Referring to FIG. 14(*a*), in a case where the pixels of the topmost toner layer of the multilayer toner image on the recording sheet P, and the toner layer thereunder, were formed with the use of the dither method of the line growth type, the space S surrounded by the transfer film 74, topmost toner layer of the multilayer toner image, and the toner layer thereunder, is roughly in the form of a parallelepiped, in a plan view, as shown in FIG. 14(*a*). Further, there are multiple spaces S in the heating nip. In this case, even if the spaces S are increased in internal pressure by heating, there is no escape route for the air and water vapor in the spaces S, because the spaces S remain surrounded by the topmost toner layer and the toner layer thereunder. Thus, the spaces S grow downstream, in terms of the recording medium conveyance direction, where the nip pressure is lower and the toner layers have melted more and therefore, lower in viscosity. Eventually, the air and water vapor burst out downstream, causing the gloss imperfections.

On the other hand, in a case where the topmost toner layer and toner layer thereunder of the multilayer toner image on the recording sheet P were formed by the dither method of the dot growth type, each of the spaces S surrounded by the transfer film 74, the topmost toner layer and the toner layer thereunder has escape routes through which the air and water vapor can escape upstream and/or downstream in terms of the recording medium conveyance direction, as shown in FIG. 14(*b*). Therefore, the gloss imperfections attributable to the above-described phenomenon that the air and water vapor burst downstream out of the spaces S do not occur.

Next, referring to FIGS. 14(*c*) and 14(*d*), in the case of a print which is high in the density of the multilayer toner image thereon, as the print is conveyed through the heating nip, the sealed spaces S are going to be formed, regardless of whether the topmost toner layer and toner layer thereunder of the multilayer toner image on the print are formed of the dither method of the line growth or dot growth type. In this case, however, the spaces S are smaller in volume. Therefore, the combination of the air and water vapor which bursts out downstream are also small. Thus, the resultant gloss imperfections are smaller.

In other words, it is reasonable to say that the extent of the gloss imperfections is affected by the pixel structure of the topmost toner layer and toner layer thereunder, in particular, the topmost toner layer, of the multilayer toner image on the recording sheet P.

Given above is the description of the mechanism which causes the gloss imperfections to occur along the line of pixel alignment of the topmost toner layer of the multilayer toner image on the recording sheet P, which is to be changed in surface texture by the gloss change process. Next, the effects of the present invention are described in detail using the image forming apparatuses in the preferred embodiments of the present invention and the comparative image forming apparatuses (conventional image forming apparatuses).

<1-5: Image Forming Apparatuses in Accordance with Present Invention and Conventional Image Forming Apparatuses>

Embodiment 1

The image forming stations Pa, Pb, Pc and Pd of the image forming apparatus in this embodiment, shown in FIG. 1, uses four toners, that is, black, magenta, cyan, and yellow toners, and form black, magenta, cyan, and yellow toner images, respectively. When the image forming apparatus is in the recording mode B, that is, the mode in which the apparatus is to carry out an image forming operation inclusive of the gloss change operation, the control section 100 of the apparatus controls the four image forming stations so that they use the following halftone screens, different in angle, to form an image:

Image Forming Station Pa (black): line growth dither method at 0°

Image Forming Station Pb (magenta): line growth dither method at 75°

Image Forming Station Pc (cyan): line growth dither method at 15°

Image Forming Station Pd (yellow): dot growth dither method at 45°

In the image forming station Pd which forms the topmost toner image, the "dot concentration dither method" is employed to provide a yellow monochromatic toner image with tonal gradation with the use of the toner growth dither method.

Embodiment 2

Figure 8:
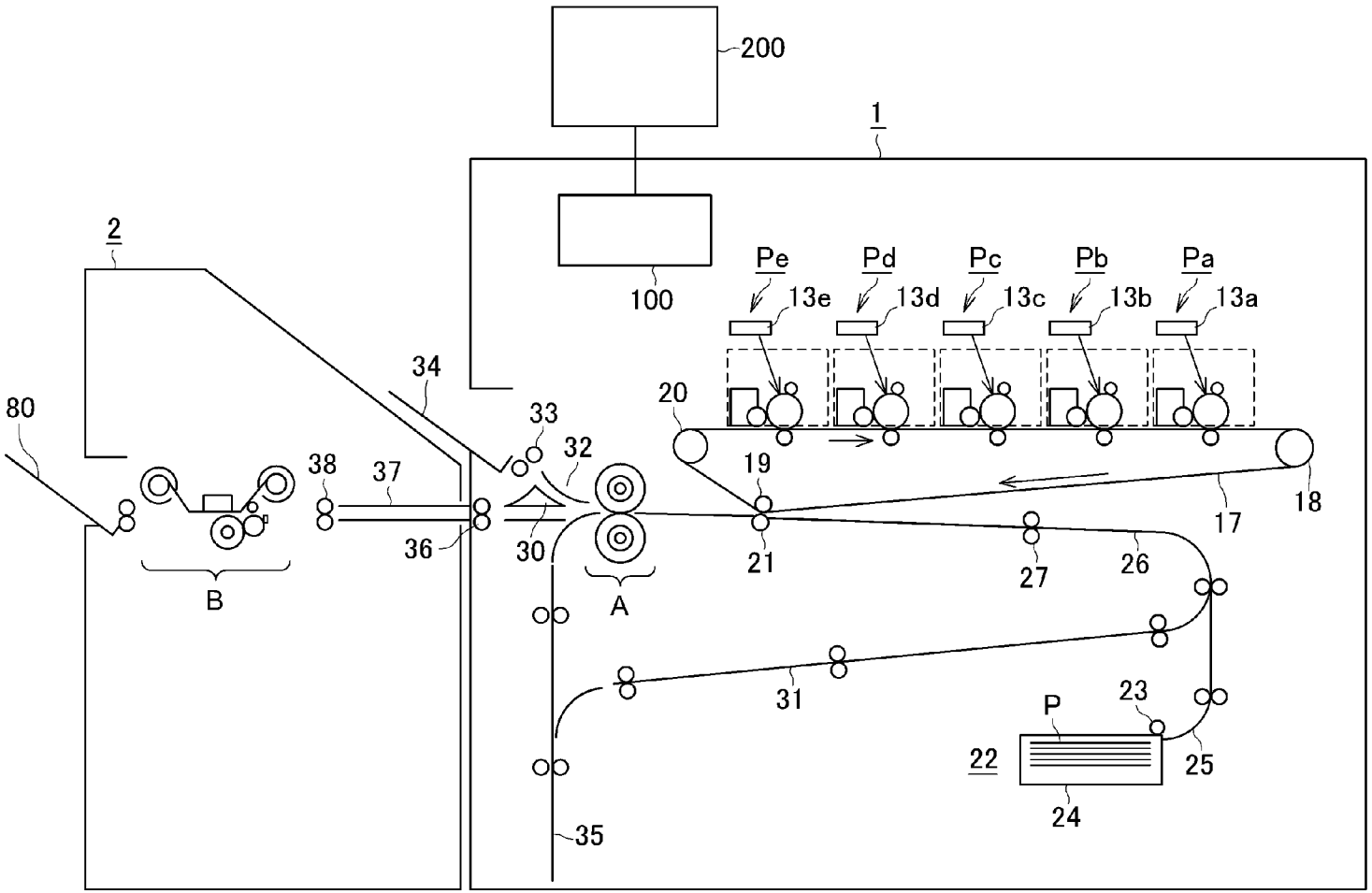
FIG. 8 is a schematic sectional view of the image forming apparatus in the first preferred embodiment, and shows the general structure of the apparatus.

The image forming apparatus in this embodiment has five image forming stations Pa, Pb, Pc, Pd and Pe, as shown in FIG. 8. Otherwise, the structure of this image forming apparatus is the same as that of the image forming apparatus in the first embodiment. The image forming stations Pa, Pb, Pc, Pd, and Pe use black, magenta, cyan, yellow, and transparent (clear) toners, respectively, and form black, magenta, cyan, yellow, and transparent monochromatic toner images, respectively.

The special feature of this image forming apparatus is that during an image forming operation, a transparent monochromatic image is formed in the image forming station Pe, and is sequentially transferred onto the full-color toner image effected by the preceding four image forming stations. When the image forming apparatus is in the recording mode B, that is, the mode in which the apparatus is to carry out an image forming operation inclusive of the gloss change operation, the control section 100 of the apparatus controls the five image forming stations so that they use the following halftone screens, different in angle, to form an image:

Image Forming Station Pa (black): line growth dither method at 0°

Image Forming Station Pb (magenta): line growth dither method at 75°

Image Forming Station Pc (cyan): line growth dither method at 15°

Image Forming Station Pd (yellow): dot growth dither method at 45°

Image Forming Station Pe (transparent): dot concentration dither method at 45°

As described above, in this embodiment, the "dot concentration dither method" is employed by the image forming station Pe, which forms the topmost toner image, to provide a transparent toner image with tonal gradation with the use of the dot growth method. Further, when the image forming apparatus is in the recording mode B, the image forming station Pe is made to operate so that an 80% image is drawn across the entirety of the image formation area of the recording sheet P with the use of the dot concentration dither method. Otherwise, the image forming operation of this image forming apparatus is the same as that of the apparatus in the first embodiment described above.

Embodiment 3

The image forming apparatus in this embodiment is the same in structure as the one in the second embodiment. When the image forming apparatus in this embodiment is in the recording mode B, that is, the mode in which the apparatus is to carry out an image forming operation inclusive of the gloss change process, its control section 100 causes the image forming stations of the apparatus to create halftone screens by processing the image formation signals with the use of the following screen angles.

Image Forming Station Pa (black): line growth dither method at 0°

Image Forming Station Pb (magenta): line growth dither method at 75°

Image Forming Station Pc (cyan): line growth dither method at 15°

Image Forming Station Pd (yellow): dot growth dither method at 45°

Image Forming Station Pe (transparent): error dispersion method.

As described above, in this embodiment, the "error dispersion method" is employed by the image forming station Pe, which forms the topmost toner layer. In other words, the tonal gradation of the transparent image is provided with the use of the "dot growth method". Further, when the image forming apparatus is in the recording mode B, a transparent image which is 80% in image density is formed across the entirety of the image formation area of the recording sheet P with the use of the error dispersion method. Otherwise, the structure and image forming operation of this apparatus are the same as those of the apparatus in the second embodiment.

Embodiment 4

The image forming apparatus in this embodiment is the same in structure as that in the third embodiment. When the apparatus is in the recording mode B, the image forming station Pe of this apparatus forms such a transparent toner image, which is 80% in density and covers the multicolor toner image on the recording sheet P only across the areas which are to be changed in gloss by the gloss changing unit 2, as it is transferred onto the recording sheet P. Otherwise, this image forming apparatus is the same as the apparatus in the third embodiment. As described above, in this embodiment, the "error dispersion method" is employed by the image forming station Pe, which forms the topmost toner layer. In other words, the tonal gradation of the transparent toner image is provided with the toner growth dither method.

(Comparative Image Forming Apparatus 1)

The first example of a comparative image forming apparatus is structured as shown in FIG. 1. Its four image forming stations Pa, Pb, Pc and Pd use black, magenta, cyan, and yellow toners, respectively. If the recording mode B is selected, the image forming stations Pa, Pb, Pc, and Pd create halftone screens having the following screen angles:

Image Forming Station Pa (black): line growth dither method at 0°

Image Forming Station Pb (magenta): line growth dither method at 75°

Image Forming Station Pc (cyan): line growth dither method at 15°

Image Forming Station Pd (yellow): line concentration dither method at 45°

(Comparative Image Forming Apparatus 2)

The second example of a comparative image forming apparatus also is structured as shown in FIG. 1. Its four image forming stations Pa, Pb, Pc and Pd use black, magenta, cyan, and yellow toners, respectively. If the recording mode B is selected, the image forming stations Pa, Pb, Pc and Pd create halftone screens having the following screen angles:

Image Forming Station Pa (black): line growth dither method at 45°

Image Forming Station Pb (magenta): line growth dither method at 75°

Image Forming Station Pc (cyan): line growth dither method at 15°

Image Forming Station Pd (yellow): line concentration dither method at 0°

<1-6: Evaluation Method>

The image forming apparatuses in the first to fourth embodiments of the present invention, and the first and second examples of comparative image forming apparatus, which are conventionally structured, are comparatively evaluated in terms of "gloss uniformity" and "gloss moire". The method used for the evaluation is as follows.

[Gloss Uniformity Evaluation Method]

Figure 10:
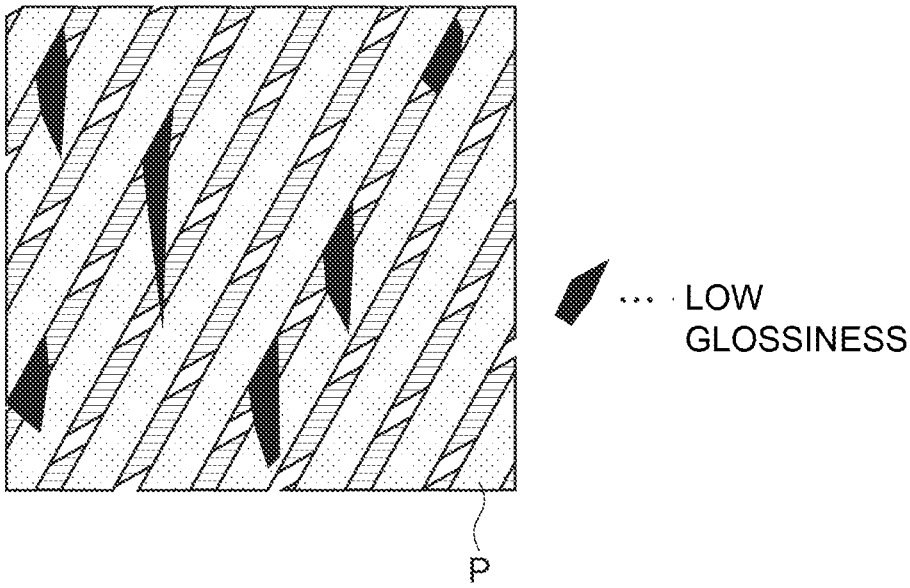
FIG. 10 is an enlarged view of a part of an image, which is unsatisfactory in gloss.

First, a copy of an IT8.7/3 chart made up of multiple patches different in density is outputted on a recording sheet of A4 size, using the image formation unit 1 of the image forming apparatus. Then, the copy of the chart is changed in gloss across the entirety of the copy by the gloss changing device B. Then, the copy of the chart is outputted from the gloss changing device B. FIG. 10 is an enlarged view of a part of the copy of the chart after it was changed in gloss. The gloss imperfections with which the present invention is concerned are the low gloss areas shown in FIG. 10. These imperfections are distinctive in that the low gloss areas are located along the line of alignment of the pixels of the toner images (layers) on the recording sheet P. The frequency with which the gloss imperfections occurred across each density patch was visually evaluated, and the ratio of the occurrence of the gloss imperfections among all the density patches was obtained. Then, the evaluations were classified into the following three levels, based on a subjective standard.

G: ratio of patches suffering from gloss imperfections is no more than 10%

F: ratio of patches suffering from gloss imperfections is in a range of 10%-40%

NG: ratio of patches suffering from gloss imperfections is no less than 40%

[Gloss Moire Evaluation]

Figure 11:
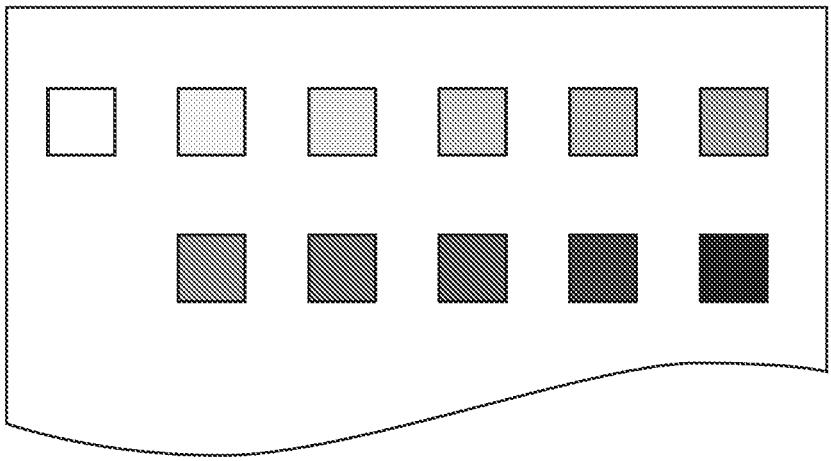
FIG. 11 is a drawing of an example of an original having tonal gradation patches arranged in the ascending order of density.

First, a copy of a print having gradation patches as shown in FIG. 11 was outputted on a recording sheet P of A4 size. Each patch in FIG. 11 is in the form of a ½ inch square. The patches are of the secondary color made up of cyan and magenta colors, or one of the primary color components. They are arranged in such an image density order that the top left patch is the solid white, that is, the patch which is lowest in image density, and the patch on the right side of a given patch is 10% higher in image density than the left side patch. Next, the entirety of the copy having the gradation patches is changed in gloss by the gloss changing device, and a copy is outputted from the gloss changing device. The image imperfections concerned in this case are the so-called gloss moire, which is a phenomenon that the vertical position of the top surface of the topmost toner image is affected by the height of the toner image, or images thereunder, being therefore uneven, and therefore, the surface displays periodic variation in the reflectivity, and therefore, the positive reflection light displays moire. The frequency of the occurrences of these image imperfections to each patch is visually evaluated, and the ratio of the occurrence is obtained for all density levels. The following is the summary of the results of the subjective evaluation, in which the evaluations were classified into three categories:

G: ratio of patches suffering from moire is no more than 10%

F: ratio of patches suffering from moire is in a range of 10%-30%

NG: ratio of patches suffering from moire is no less than 30%

Given in Table 1 are the results of the evaluation.

TABLE 1

| | Structures | | | Evaluation | | |
|---|---|---|---|---|---|---|
| | Top toner image | Dots in topmost layer | Clean toner area | Gloss evennes | Moire | Clean toner consumption |
| EMB. 1 | Yellow | Dot growth: 45° | No | F | No | No |
| EMB. 2 | Clean toner | Dot growth: 45° | All | G | F | Large |
| EMB. 3 | Clean toner | Error diffusion | All | G | G | Large |
| EMB. 4 | Clean toner | Error diffusion | Processsed part only | G | G | Small |
| COMP. 1 | Yellow | Line growth: 45° | No | NG | No | No |
| COMP. 2 | Yellow | Line growth: 0° | No | F | No | No |

In the case of the first example of the comparative image forming apparatus, the line growth dither method was used across the entirety of the image formation area of the recording sheet P for image formation. That is, the entire pixels of the topmost toner layer were formed by the line growth dither method. Therefore, the laminar structure of the multilayer multicolor image is such that even as the air and water vapor in the spaces S are made to increase in pressure by the gloss changing process, they cannot escape from the spaces S, as described previously with reference to FIG. 14(*a*). Therefore, the first example is greater in the ratio of the image density patches which suffer from the gloss imperfections attributable to the pixel structure. In other words, the first example is inferior in terms of gloss uniformity.

In the case of the second example of the comparative image forming apparatus, the pixels of the topmost toner image were formed also with the line growth dither method alone. However, the screen angle was 0°. In this case, therefore, there are escape routes for the air and water vapor as shown in FIG.

14(*e*). Therefore, this example is better than the first example, being about the same as the image forming apparatus in the first embodiment, in terms of the gloss imperfections attributable the pixel structure. From the standpoint of preventing the occurrence of gloss imperfections, this example, however, can afford less latitude in terms of the skewing of a recording sheet, the positional accuracy with which toner images are transferred in each image forming station. Thus, this apparatus is narrower in the field of usage.

In comparison, in the case of the image forming apparatus in the first embodiment, the pixels of the topmost toner layer of the multilayer multicolor image are formed with the use of the dot growth dither method. Therefore, there are escape routes through which the air and water vapor are allowed to escape from the spaces S as they expand, as described with reference to FIG. 14(*b*). Therefore, the image density patches which are distinctive in that their gloss imperfections were attributable to the pixel structure, were smaller in ratio, and therefore, were smaller in the gloss imperfection ratio. Incidentally, in the case of this apparatus, the topmost toner layer is a monochromatic yellow toner layer. However, the same effects as those obtained by this apparatus can be obtained even if the apparatus is structured so that the topmost toner layer is a monochromatic layer of one of the other colors than yellow.

In the case of the image forming apparatus in the second embodiment, the topmost toner layer is always formed with the use of the transparent toner. Further, the pixels of the transparent toner image are formed with the use of the dot growth dither method. Therefore, there are always escape routes for the air and water vapor in the spaces S, regardless of the density of an image to be formed. Therefore, this apparatus is significantly smaller in the ratio of the gloss imperfections attributable to the pixel structure, being therefore significantly better in gloss, than the apparatus in the first embodiment.

In the case of the image forming apparatus in the third embodiment, the topmost toner layer, which is a transparent toner image, is formed with the use of the error dispersion method. Therefore, not only was it smaller in the amount of the gloss imperfections attributable to the pixel structure, but also, the gloss moire attributable to the pattern of each of the toner layers under the topmost toner layer were under control.

In the case of the image forming apparatus in the fourth embodiment, the transparent layer (toner image) is formed only across the areas of the print which are to be changed in gloss. Therefore, not only could it obtain the same effects as those obtainable by the apparatus in the third embodiment, but also, it was smaller in the amount of the consumption of the transparent toner. That is, this embodiment made it possible for an image forming apparatus to output high quality images while reducing the apparatus in operational cost.

<1-7: Effects of First Embodiment>

If the gloss changing mode is selected, the image forming station of the image forming apparatus in this embodiment, which is for forming the topmost toner image, uses the dot growth dither method to provide the gradation, and then, changes in gloss the topmost toner image. Therefore, one of the causes of the formation of an unsatisfactory image, more specifically, the phenomenon that the air and water vapor are made to burst out from the spaces S in which there are trapped, is unlikely to occur.

In other words, this embodiment makes it possible to provide any portion of a print with a highly glossy appearance, such as that of an ordinary photograph. In particular, this embodiment makes it possible to provide an image forming apparatus which is significantly smaller in the amount of the gloss imperfections which are likely to occur along the line of pixel alignment when a print is processed for a high level of gloss, than any image forming apparatus in accordance with the prior art. As is evident from the detailed description of this embodiment of the present invention, the present invention can provide an image forming apparatus and a gloss changing apparatus (device) which can partially change a print in gloss without making the print appear imperfect in gloss.

Embodiment 2

<2-1: Gloss Changing Apparatus (Device)>

Figure 9:
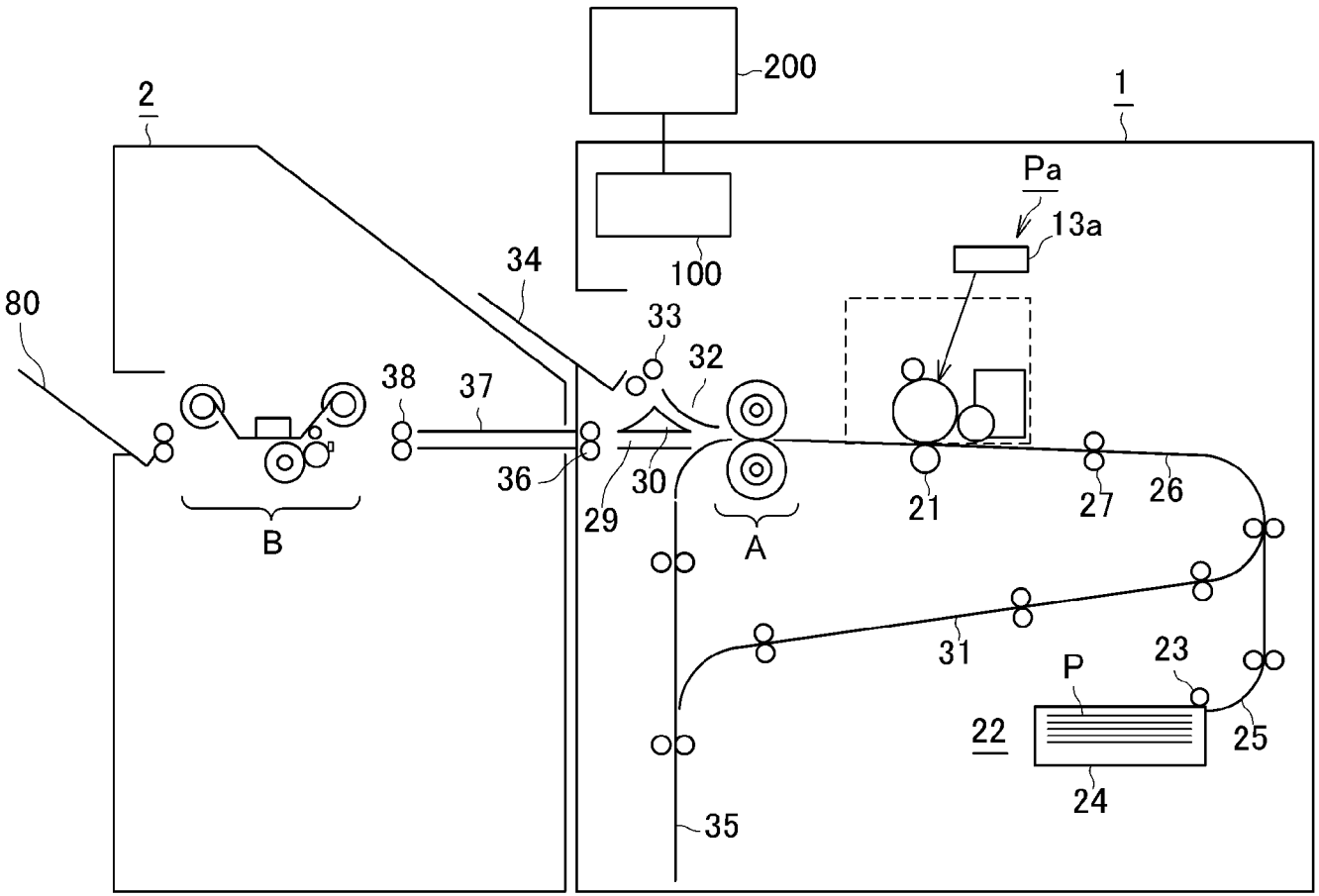
FIG. 9 is a schematic sectional view of the image forming apparatus in the second preferred embodiment, and shows the general structure of the apparatus.

Next, referring to FIG. 9, the image forming apparatus in this embodiment is described. Designated by a referential code 1 is an image formation unit for forming a toner image of thermoplastic resin, and designated by a referential code 2 is a gloss changing unit, which is in connection to the print outlet the image formation unit 1. The image formation unit 1 is provided with an internal image forming station Pa. It is an electrophotographic image formation unit, and is for forming a layer (image) of thermoplastic resin on a sheet P of recording medium. The gloss changing unit 2 in this embodiment is the same as that of the above described image forming apparatus in the first embodiment. Here, a term "image forming apparatus" means a combination of the image forming apparatus 1 (having only one image forming station), and the gloss changing unit 2.

That is, the image forming apparatus in this embodiment is roughly the same in structure as the image forming apparatus in the first embodiment. That is, the image forming apparatus in this embodiment is different from that in the first embodiment in that unlike the apparatus in the first embodiment, it is not a full-color image forming apparatus, and does not have an intermediary transferring member. However, this image forming apparatus is capable of changing in gloss a full-color print outputted from image forming apparatuses other than this apparatus. That is, when it is necessary to change a color print (combination of a sheet P of recording medium and color image thereon) outputted from an image forming apparatus other than this image forming apparatus, the color print is to be placed in a sheet feeder cassette 24. As the image forming apparatus is started, a layer of thermoplastic resin (transfer parent toner, for example) is transferred onto a part, parts, or the entirety of the image bearing surface of the color print, and fixed. Then, the print is processed by the gloss changing unit 2. Thus, the image forming apparatus in this embodiment is usable for partially or entirely coating the image bearing surface of the print, partially or entirely changing the print in superficial texture (appearance), or the like purposes.

The image forming apparatus in this embodiment has the first and second operation modes (recording modes A and B, respectively). The first mode is for forming a layer of thermoplastic resin (transparent toner, for example) across a part, parts, or entirety of the image bearing surface of a sheet of recording medium, and discharging the sheet of recording medium without changing in gloss the resin coated surface of the recording sheet. The second recording mode is for forming a layer of thermoplastic resin across a part, parts, or entirety of the image bearing surface of a sheet of recording medium, and changing the image bearing surface of the recording sheet in gloss before discharging the recording sheet.

If a user selects the recording mode A, that is, the mode in which a recording sheet is discharged without being changed in gloss, the pattern in which a halftone screen is to be formed is to be selected by the user, or automatically selected by the control section 100, which makes the apparatus forms a halftone screen in the selected pattern (with the use of the selected image pattern processing method).

On the other hand, if the recording mode B, which is the recording mode for discharging a print from the image forming apparatus, without changing the print in gloss after the print is completed by the image formation unit, the image forming portion Pa of the image forming apparatus employs the image formation pattern processing method other than the line growth dither method. That is, a halftone screen is created by the dot concentration dither method, or the image formation pattern processing method of the dot growth type, such as the error dispersion method, is employed. Then, the surface of the print, which is partially or entirely covered with a layer of thermoplastic resin (transparent toner image) is subjected to a gloss changing process.

<2-2: Effects of Second Embodiment>

At this time, the fifth embodiment of the present invention is described. It was a full-color print outputted from an electrophotographic image forming apparatus other than the image forming apparatus in the fifth embodiment that was used to test the image forming apparatus in the fifth embodiment. In the test, an image is formed of transparent thermoplastic resin in the image forming station Pa. When the apparatus was in the recording mode B, that is, the mode in which the print is to be subjected to the gloss changing process, such a transparent image that covers only the areas of the print, which are to be subjected to the gloss changing process, was formed in the image forming station Pa at 80% density, with the use of the error dispersion method. Then, the completed print, that is, the print subjected to the gloss changing process, was evaluated in terms of the above described "gloss uniformity" and "gloss moire". The method and criteria used to evaluate the prints, the gloss of which was changed by the image forming apparatus in the fifth embodiment, was the same as those used to evaluate the prints, the gloss of which was changed by the image forming apparatus in the first embodiment. The results of the evaluation of the image forming apparatus in the fifth embodiment are given, along with the results of the evaluation of in the following Table 2, which contains also the results of the evaluation of the first and second examples of the comparative image forming apparatuses, which were given in Table 1 along with the results of the evaluation of the image forming apparatus in the first embodiment.

TABLE 2

| | Structures | | | Evaluation | | |
|---|---|---|---|---|---|---|
| | Top toner image | Dots in topmost layer | Clean toner area | Gloss evennes | Moire | Clean toner consumption |
| EMB. 5 | Thermoplastic resin | Error diffusion | Processsed part only | G | G | Small |
| COMP. 1 | Yellow | Line growth: 45° | No | NG | No | No |
| COMP. 2 | Yellow | Line growth: 0° | No | F | No | No |

When a print outputted by an image forming apparatus other than the image forming apparatus in the fifth embodiment was changed in gloss with the use of the image forming apparatus in the fifth embodiment, the apparatus in the fifth embodiment was significantly less in the amount of gloss imperfections attributable to pixel structure and the amount of the moire attributable to gloss, regardless of the image density of the print. Further, it formed a layer (image) of thermoplastic resin only across the area or areas of the print, which are to be changed in gloss. Therefore, it was significantly smaller in the amount of the consumption of the thermoplastic resin than a gloss changing device and an image forming apparatus in accordance with the prior art. That is, the image forming apparatus in the fifth embodiment was significantly higher in image quality and lower in operational cost than a gloss changing device (apparatus) and an image forming which are in accordance with the prior art.

As described above, in this embodiment, if the gloss change mode is selected, the dot growth method is used to form a layer of thermoplastic resin on the topmost toner image of the multilayer image formed by the image formation unit of an image forming apparatus, or an image forming apparatus other than the image forming apparatus to which the gloss changing unit belongs. Therefore, the phenomenon that the air and water vapor trapped in the microscopic spaces formed in a multilayer toner image when the multilayer toner image was formed by transferring multiple monochromatic toner images onto a sheet of recording medium burst out of the microscopic spaces during the process for changing a print in gloss, that is, one of the primary causes of the occurrence of gloss imperfections, is unlikely to occur. In other words, the present invention can provide an image forming apparatus which can partially change a print in gloss, without making the print imperfect in gloss.

[Miscellanies]

In terms of the structure of an image forming apparatus, in particular, the structural arrangement for transferring a toner image, the application of the present invention is not limited to the above described one. That is, not only is the present invention applicable to an image forming apparatus which employs an intermediary transferring means, but also, an image forming apparatus of the direct transfer type, which transfers a toner image onto recording medium directly from a photosensitive drum. Further, the present invention is also applicable to an image forming apparatus structured so that the image formation pattern processing for the images other than the topmost toner image is selectable by a user, or automatically selected by the control section 100 from among the image formation patterns stored in the control section 100. Further, the present invention is applicable to an image forming apparatus structured so that the method for processing the image formation pattern for the topmost toner image is selected by a user. That is, the application of the present invention to the image forming apparatuses different in structure from those in the first and second embodiments can provide the same effects as those obtainable by the image forming apparatuses in the first and second embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 280768/2010 filed Dec. 16, 2010 which is hereby incorporated by reference.

What is claimed is:

1. An image forming apparatus comprising:

a plurality of image forming stations for forming a toner image having superposed toner image components on a recording material;

a fixing portion for fixing the toner image on the recording material; and a glossiness treatment unit, operable when a glossiness treatment mode is selected, for glossiness treatment of the toner image fixed on the recording material by heating the toner image, said glossiness treatment unit including a film movable in a feeding direction of the recording material, a heating member contacting said film, a pressing member cooperating with said heating member to form a nip, with said film therebetween, for nipping and feeding the recording material;

wherein in the glossiness treatment mode, one of said image forming stations forms, as a topmost layer, a toner image having a tone gradation provided by a dot growth type screening, and wherein an image forming station, other than said one for forming the topmost toner image forms the toner image having the tone gradation provided by a line growth type screening.

2. An apparatus according to claim 1, wherein the dot growth type screening is of a dot concentration dither type.

3. An apparatus according to claim 1, wherein the dot growth type screening is of an error diffusion type.

4. An apparatus according to claim 1, wherein said heating member includes a plurality of heat generating elements arranged along a direction substantially perpendicular to a moving direction of said film, and said heat generating elements are actuatable independently from each other.

5. An apparatus according to claim 1, wherein a thickness of said film is not less than 4 μm and not more than 40 μm.

6. An apparatus according to claim 1, wherein the topmost layer comprises transparent toner.

7. An apparatus according to claim 1, wherein said glossiness treatment unit further includes a separating member for separating said film from the recording material, said separating member being provided with a cooling system.

8. An apparatus according to claim 7, wherein a temperature of said separating member is kept no higher than a target cooling level, by said cooling system.

9. An image forming apparatus comprising:

a plurality of image forming stations for forming a toner image having superposed toner image components on a recording material;

a fixing portion for fixing the toner image on the recording material; and a glossiness treatment unit, operable when a glossiness treatment mode is selected, for glossiness treatment of the toner image fixed on the recording material by heating the toner image, said glossiness treatment unit including a film movable in a feeding direction of the recording material, a heating member contacting said film, a pressing member cooperating with said heating member to form a nip, with said film therebetween, for nipping and feeding the recording material;

wherein in the glossiness treatment mode, one of said image forming unit stations forms, as a topmost layer, a toner image having a tone gradation provided by a dot growth type screening, and wherein an image forming station, other than said one for forming the topmost toner image, forms the toner image having the tone gradation provided by a screening other than the dot growth type screening.

10. An apparatus according to claim 9, wherein the dot growth type screening is of a dot concentration dither type.

11. An apparatus according to claim 9, wherein the dot growth type screening is of an error diffusion type.

12. An apparatus according to claim 9, wherein said heating member includes a plurality of heat generating elements arranged along a direction substantially perpendicular to a moving direction of said film, and said heat generating elements are actuatable independently from each other.

13. An apparatus according to claim 9, wherein a thickness of said film is not less than 4 μm and not more than 40 μm.

14. An apparatus according to claim 9, wherein the topmost layer comprises transparent toner.

15. An apparatus according to claim 9, wherein said glossiness treatment unit further includes a separating member for separating said film from the recording material, said separating member being provided with a cooling system.

16. An apparatus according to claim 15, wherein a temperature of said separating member is kept no higher than a target cooling level, by said cooling system.

* * * * *